US012480279B2

(12) United States Patent
Otsuka

(10) Patent No.: US 12,480,279 B2
(45) Date of Patent: Nov. 25, 2025

(54) WORK MACHINE

(71) Applicant: Yanmar Holdings Co., Ltd., Osaka (JP)

(72) Inventor: Yosuke Otsuka, Fukuoka (JP)

(73) Assignee: Yanmar Holdings Co., Ltd., Osaka (JP)

( * ) Notice: Subject to any disclaimer, the term of this patent is extended or adjusted under 35 U.S.C. 154(b) by 338 days.

(21) Appl. No.: 17/898,462

(22) Filed: Aug. 29, 2022

(65) Prior Publication Data

US 2023/0066865 A1 Mar. 2, 2023

(30) Foreign Application Priority Data

Aug. 30, 2021 (JP) ..... 2021-139577

(51) Int. Cl.
*E02F 9/08* (2006.01)

(52) U.S. Cl.
CPC ..... *E02F 9/0866* (2013.01); *E02F 9/0891* (2013.01)

(58) Field of Classification Search
CPC ..... E02F 9/0866; E02F 9/0891
See application file for complete search history.

(56) References Cited

U.S. PATENT DOCUMENTS

| | | | | |
|---|---|---|---|---|
| 12,129,630 | B2 | 10/2024 | Ishii | |
| 2008/0035401 | A1 | 2/2008 | Ishii et al. | |
| 2013/0140927 | A1* | 6/2013 | Murata | E02F 9/0858 310/71 |
| 2014/0021781 | A1* | 1/2014 | Satake | E02F 9/0866 307/9.1 |
| 2014/0034403 | A1* | 2/2014 | Tokuda | E02F 9/0866 180/89.12 |
| 2014/0161578 | A1 | 6/2014 | Kimura et al. | |
| 2015/0125248 | A1* | 5/2015 | Sasaki | E02F 3/32 414/744.2 |
| 2016/0222631 | A1* | 8/2016 | Kohno | H01M 10/647 |
| 2016/0305090 | A1* | 10/2016 | Saiki | E02F 9/0858 |
| 2016/0324039 | A1* | 11/2016 | Souda | E02F 9/0866 |
| 2017/0016206 | A1* | 1/2017 | Ota | E02F 9/0858 |

FOREIGN PATENT DOCUMENTS

| | | | | |
|---|---|---|---|---|
| CN | 112105858 | A * | 12/2020 | B60R 16/02 |
| JP | 2002167800 | A * | 6/2002 | E02F 9/00 |
| JP | 2010203140 | A * | 9/2010 | E02F 9/00 |
| JP | 2012075286 | A | 4/2012 | |
| JP | 2013121871 | A | 6/2013 | |
| JP | 2014101660 | A | 6/2014 | |
| JP | 2019218738 | A | 12/2019 | |

* cited by examiner

*Primary Examiner* — Paul N Dickson
*Assistant Examiner* — Tiffany L Webb
(74) *Attorney, Agent, or Firm* — Chris Mizumoto

(57) ABSTRACT

A hydraulic excavator as a work machine is equipped with an engine room, and an electrical component mounting board located in the engine room, on which at least a first and second electrical components are mounted. The first electrical component is mounted on either a front or back side of the electrical component mounting board. The second electrical component is mounted on the other of the front or back side of the electrical component mounting board.

9 Claims, 13 Drawing Sheets

WORK MACHINE

CROSS-REFERENCE

This application claims foreign priority of JP2021-139577 filed Aug. 30, 2021, the disclosure of which is hereby incorporated by reference in its entirety.

TECHNICAL FIELD

This invention relates to a work machine equipped with an engine room.

BACKGROUND ART

Conventionally, a technique has been proposed to place multiple controllers in the engine room of a hydraulic excavator. For example, in Patent Literature 1, a plurality of controllers are fixed to a mounting plate, the mounting plate is fixed to a housing to form a controller housing device, and this controller housing device is placed in the engine room.

PRIOR ART DOCUMENT

Patent Document

Patent Document 1: Japanese Patent Laid-open Publication No. 2014-101660

SUMMARY OF INVENTION

Technical Problem

In the technology of Patent Literature 1, it was necessary to use mounting plates and housings to arrange multiple controllers, which are electrical components, in the engine room, resulting in a large number of parts. Therefore, in particular when the engine room is a narrower space, such as in a small hydraulic excavator, it was impossible to efficiently place multiple electrical components within the narrower and limited space.

The present invention has been made to solve the above-mentioned problems, and an object of the present invention is to provide a work machine capable of efficiently arranging a plurality of electrical components with a small number of parts in a limited space in an engine room.

Solution to Problem

According to an aspect of the present invention, a work machine with an engine room includes an electrical component mounting board located in the engine room on which at least a first electrical component and a second electrical component are mounted, wherein the first electrical component is mounted on either a front side or a back side of the electrical component mounting board, and the second electrical component is mounted on the other of the front side or back side of the electrical component mounting board.

Advantageous Effects of Invention

According to the above-mentioned configuration, multiple electrical components can be efficiently arranged in a limited space in the engine room with a small number of parts.

DESCRIPTION OF EMBODIMENTS

The following is a description of an embodiment of the invention based on the drawings.

1. Work Machine

Figure 1:
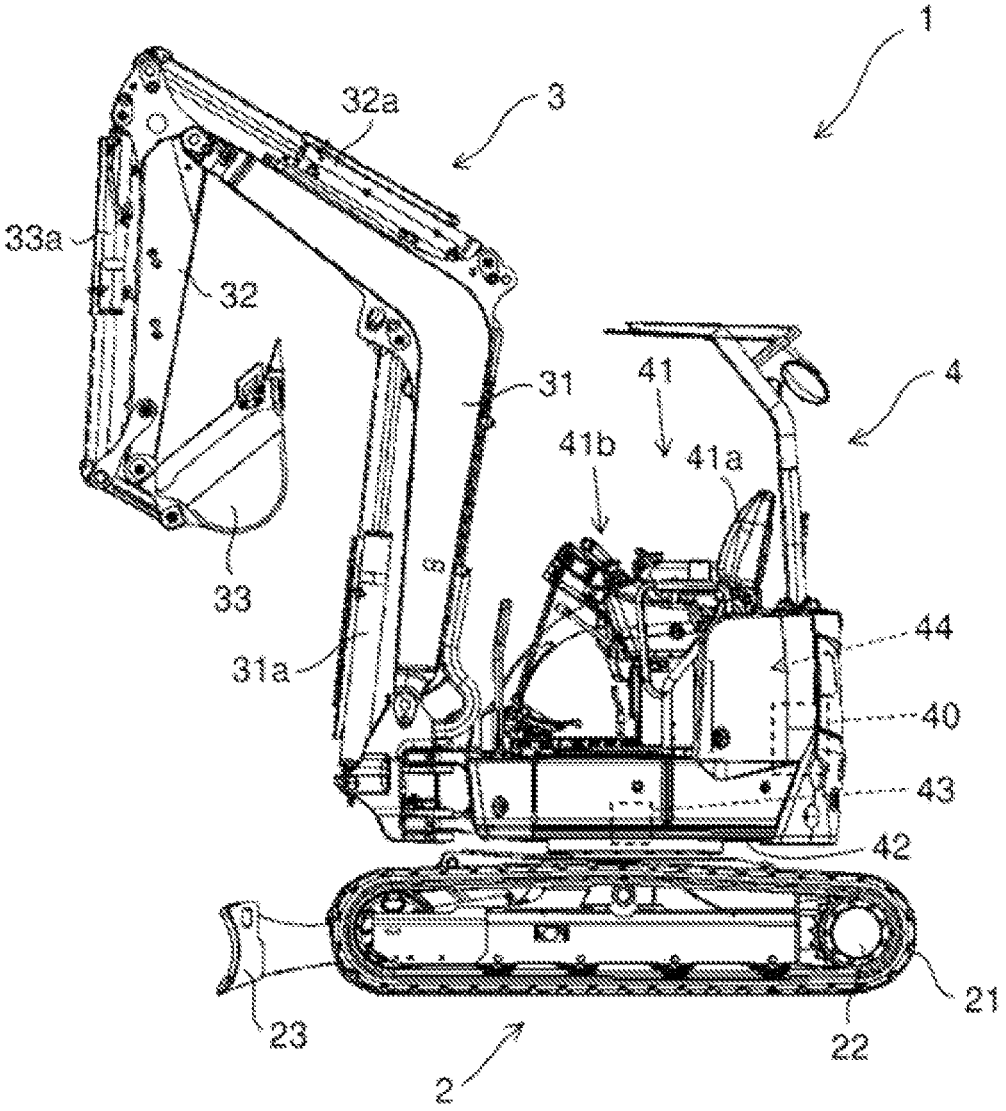
FIG. 1 is a schematic side view of a hydraulic excavator, which is an example of a work machine according to an embodiment of the present invention.

FIG. 1 is a schematic side view of a hydraulic excavator 1, which is an example of a work machine according to the present embodiment. The hydraulic excavator 1 is equipped with lower traveling body 2, work equipment 3, and upper revolving body 4.

Here, in FIG. 1, directions are defined as follows. First, the direction in which the lower traveling body 2 travels straight ahead is a front-rear direction, one side of which is "front" and the other side is "rear." In FIG. 1, blade 23's side relative to a traveling motor 22 is shown as "front" as an example. The horizontal direction perpendicular to the front-rear direction is the left-right direction. In this case, the left side is "left" and the right side is "right" as viewed from the operator seated at an operator seat 41*a*. Furthermore, the gravity direction perpendicular to the front-rear and left-right directions is defined as the vertical direction, with the upstream side of the gravity direction being "up" and the downstream side being "down".

The lower traveling body 2 is driven by power from an engine 40 to drive the hydraulic excavator 1. The lower traveling body 2 is equipped with a pair of crawlers 21 on each side and a pair of traveling motors 22 on each side. Each of the traveling motors 22 is a hydraulic motor. The left and right traveling motors 22 drive the left and right crawlers 21, respectively, to move the hydraulic excavator 1 forward and backward. The lower traveling body 2 is provided with a blade 23 for ground leveling work. The blade 23 is driven by a blade cylinder (not shown). The blade cylinder is a hydraulic cylinder to rotate the blade 23 in the vertical direction.

The work equipment 3 is driven by power from the engine 40 and performs excavation work to dig out earth and sand. The work equipment 3 has boom 31, arm 32, and bucket 33. The boom 31, arm 32, and bucket 33 can be driven independently to perform digging operations.

The boom 31 is rotated by a boom cylinder 31*a*. The boom cylinder 31*a* is supported at its base by the front of the upper revolving body 4 and is extendable and retractable freely. The arm 32 is rotated by an arm cylinder 32*a*. The arm cylinder 32*a* is supported at its base by the tip of the boom 31 and is extendable and retractable freely. The bucket 33 is rotated by a bucket cylinder 33*a*. The bucket cylinder 33*a* is supported at its base by the tip of the arm 32 and is extendable and retractable freely. Each of the boom cylinder 31*a*, the arm cylinder 32*a*, and the bucket cylinder 33*a* are composed of a hydraulic cylinder.

The upper revolving body 4 is configured to revolve with respect to the lower traveling body 2 via a revolving bearing (not shown). In the upper revolving body 4, operation unit 41, revolving frame 42, revolving motor 43, engine room 44, etc. are arranged. In other words, the hydraulic excavator 1 has at least the engine room 44. The upper revolving body 4 revolves via the revolving bearing by being driven by means of the revolving motor 43 which is a hydraulic motor. At the rear side of the upper revolving body 4, there are located the engine 40 to provide power to various parts, as well as several hydraulic pumps (not shown) driven by the engine 40.

Each hydraulic pump is connected to a hydraulic motor (e.g., left and right traveling motors 22, revolving motors 43) and supplies hydraulic oil (pressure oil) to a hydraulic cylinder (e.g., blade cylinder 23*a*, boom cylinder 31*a*, arm cylinder 32*a*, bucket cylinder 33*a*). Hydraulic motors and cylinders to which hydraulic oil is supplied from any hydraulic pump to drive them are collectively called hydraulic actuators.

An operator seat 41*a* is located in an operation unit 41 on which an operator gets. A manipulation unit 41*b* is located around the operator seat 41*a* (especially in the front, left, and right sides thereof).

The manipulation unit 41*b* is composed of operating levers, switches, buttons, etc. to drive the hydraulic actuator. Upon the operator sitting in the operator seat 41*a* operates the manipulation unit 41*b*, the hydraulic actuator is driven. This allows the lower traveling body 2 to travel, the blade 23 to perform ground leveling work, the work equipment 3 to perform excavation work and crane work, and the upper revolving body 4 to revolve, etc.

Figure 2:
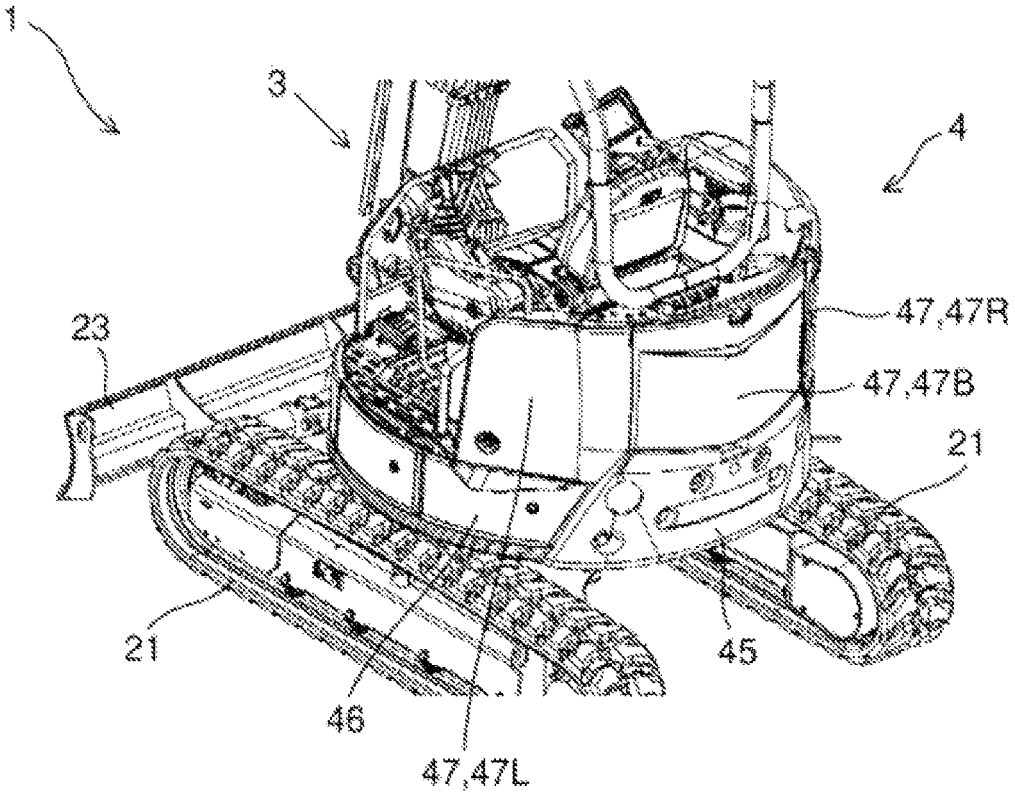
FIG. 2 is a rear perspective view of the above-mentioned hydraulic excavator.

FIG. 2 is a rear perspective view of the hydraulic excavator 1. A counterweight 45 is provided at the rear bottom of the upper revolving body 4. The counterweight 45 is located adjacent to a side frame 46 in a revolving direction. Side frames 46 rise from the left and right sides of the revolving frame 42, respectively, to be located there (see FIG. 1). A hood 47 is located above the counterweight 45 and the side frames 46. The hood 47 includes a left hood 47L located on the left side of the upper revolving body 4, a right hood 47R located on the right side of the upper revolving body 4, and a rear hood 47B located at the rear of the upper revolving body 4. In other words, the hydraulic excavator 1 has the hood 47 (e.g., the left hood 47L) located on the side of (at least) the engine room 44. Each hood 47 is removable from the frame of the upper revolving body 4.

Figure 3:
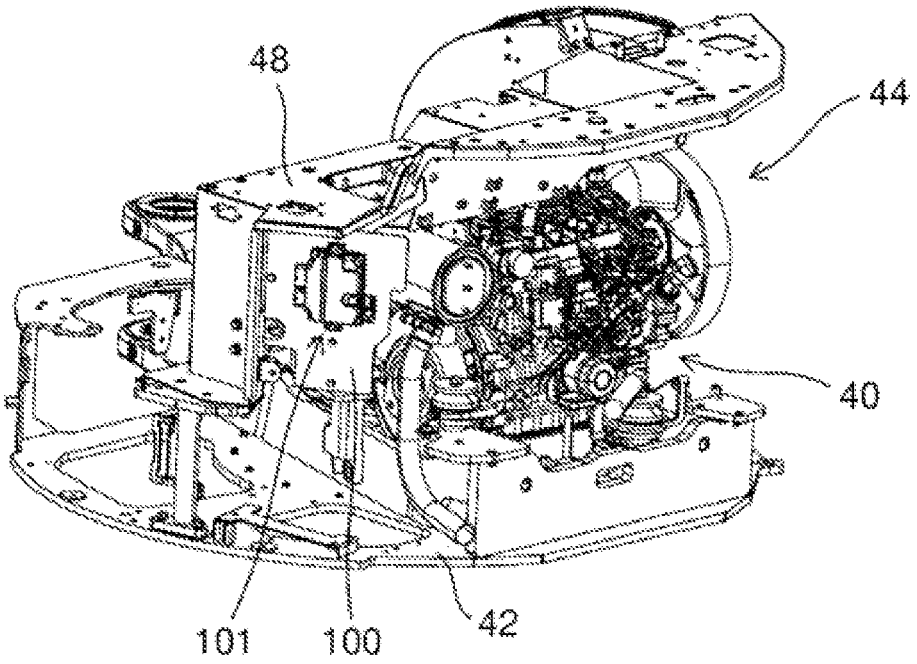
FIG. 3 is a perspective view illustrating an inside of an engine room of the above-mentioned hydraulic excavator.

FIG. 3 is a perspective view illustrating an inside of the engine room 44 of the upper revolving body 4. The engine room 44 is composed of a space surrounded by the revolving frame 42 and a seat mount 48, the counterweight 45, side frames 46 and hood 47 shown in FIG. 2. The revolving frame 42 is located at the bottom of the engine room 44. The seat mount 48 is a base on which the seat of the operator seat 41*a* (see FIG. 1) is mounted and is located above the revolving frame 42. In other words, the hydraulic excavator 1 has the revolving frame 42 located at the bottom of the engine room 44, and a seat mount 48 which is located above the revolving frame 42 and becomes a part of the outer wall of the engine room 44.

In the engine room 44, the engine 40 mentioned above is installed as a motor. In other words, the hydraulic excavator 1 is equipped with a motor (engine 40) which is installed in the engine room 44. The motor is not limited to the engine 40, but can be an electric motor, for example. The motor may be composed of both the engine 40 and the electric motor.

2. Electrical Component Mounting Board

As shown in FIG. 3, an electrical component mounting board 100 is located inside the engine room 44. In particular, in this embodiment, the electrical component mounting board 100 is located so that it faces the left hood 47L positioned at the side of the engine room 44 (see FIG. 2). Electrical components are mounted on the electrical component mounting board 100. The above-mentioned electrical components may include an integrated controller (integrated ECU) to control the entire hydraulic excavator 1, a controller (engine ECU) to control the engine 40, and electrical components such as relays, for example. The ECU is a controller called an Electronic Control Unit.

Figure 6:
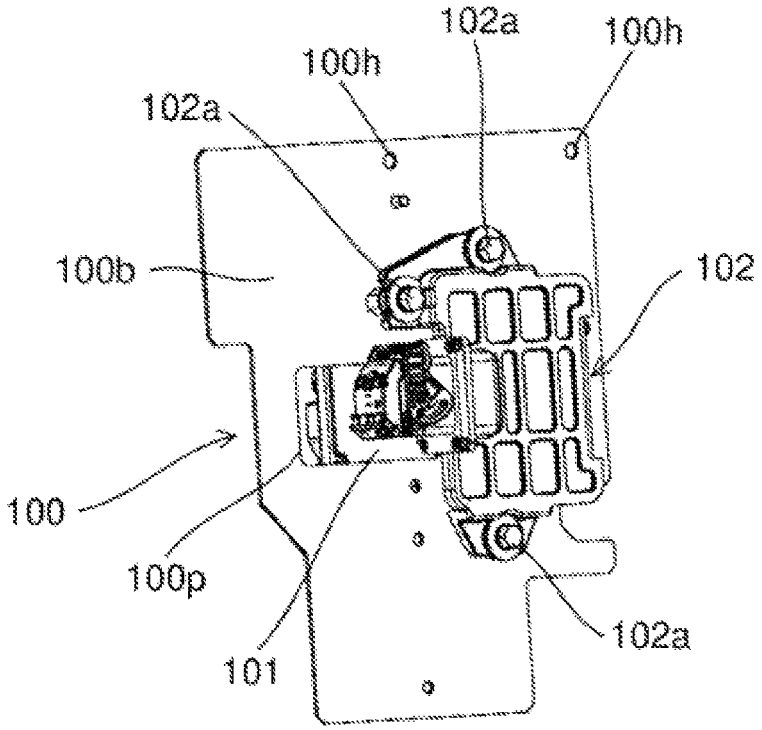
FIG. 6 is a perspective view of the above-mentioned electrical component mounting board as viewed from the mounting side of a second electrical component.

For the purpose of distinguishing each electrical component, the integrated ECU is referred to as the first electrical component 101 (see FIG. 3), and the engine ECU is referred to as the second electrical component 102 (see FIG. 6). In this case, it can be said that the hydraulic excavator 1 is provided with an electrical component mounting board 100 on which at least the first electrical component 101 and the second electrical component 102 are mounted.

Figure 4:
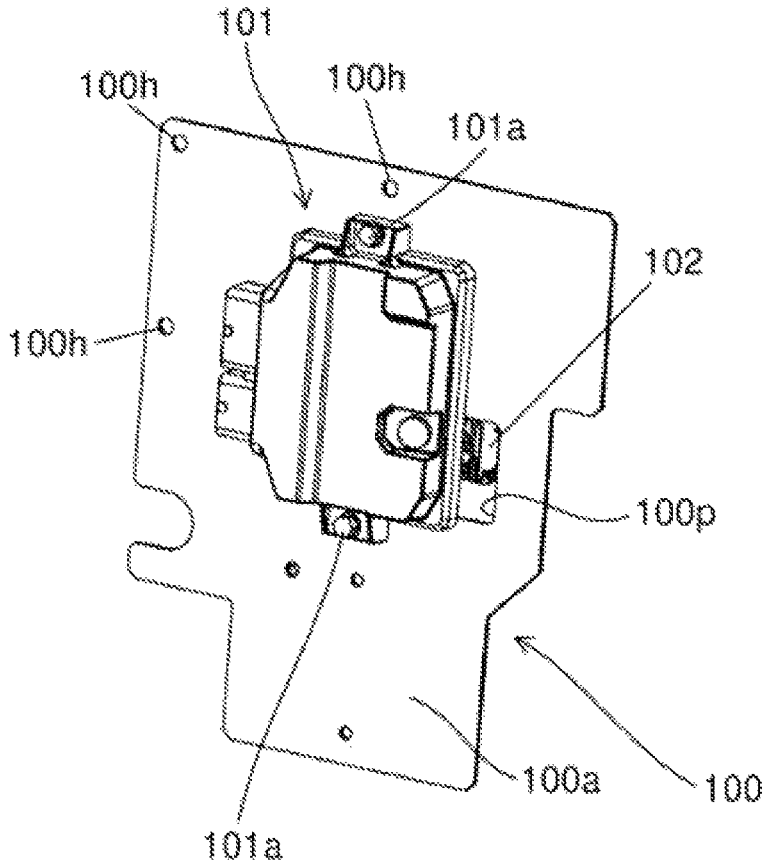
FIG. 4 is a perspective view of an electrical component mounting board located in the engine room mentioned above, as viewed from the mounting side of a first electrical component.
Figure 5:
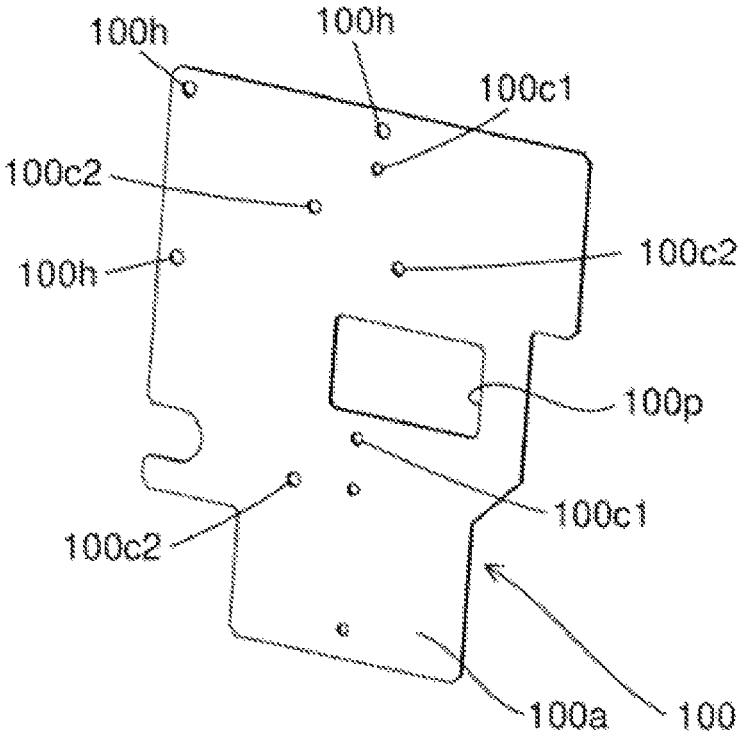
FIG. 5 is a perspective view of the above-mentioned electrical component mounting board alone.

FIG. 4 is a perspective view of the electrical component mounting board 100 as viewed from the mounting side of the first electrical component 101. FIG. 5 is a perspective view of the electrical component mounting board 100 alone. FIG. 6 is a perspective view of the electrical component mounting board 100 as viewed from the mounting side of the second electrical component 102. As shown in the drawings, the first electrical component 101 is mounted on a front side 100*a* which is one side of the electrical component mounting board 100, using bolts 101*a* and nuts (not shown), etc. The bolts 101*a* are inserted into the mounting holes 100*c*1 (see FIG. 5) provided on the electrical component mounting board 100 from the front side 100*a* and screwed into an inter circumferential surface of the above-mentioned nuts located on the back side 100*b*.

The second electrical component 102 is attached to the back side 100*b* which is the other side of the electrical component mounting board 100, using bolts 102*a* and nuts (not shown) or the like. The bolts 102*a* are inserted into the mounting holes 100*c*2 (see FIG. 5) provided on the electrical component mounting board 100 from the back side 100*b* and screwed into the inter circumferential surface of the above-mentioned nuts located on the front side 100*a* side. Despite being not shown in the drawings, the first electrical component 101 may be attached to the back side 100*b* of the electrical component mounting board 100 using bolts or the like, and the second electrical component 102 may be attached to the front side 100*a* of the electrical component mounting board 100 using bolts or the like.

Therefore, in the present embodiment, it can be said that the first electrical component 101 is mounted on either the front side 100*a* of the electrical component mounting board 100 or the back side 100*b* of the electrical component mounting board 100, and the second electrical component 102 is mounted on either the front side 100*a* of the electrical component mounting board 100 or the back side 100*b* of the electrical component mounting board 100.

In this configuration, multiple electrical components (first electrical component 101, second electrical component 102) are collectively mounted together on a sole electrical component mounting board 100. Accordingly, even if the engine room 44 is a narrower space, multiple electrical components can be efficiently arranged in the narrower and limited space with a small number of components using one electrical component mounting board 100. Therefore, the configuration using the electrical component mounting board 100 mentioned above is very effective, especially when multiple electrical components are arranged in the engine room 44 of a hydraulic excavator 1 which is a small work machine with a narrower inner space of the engine room 44.

Furthermore, as shown in FIG. 3, the first electrical component 101 mounted on the electrical component mounting board 100 is located in the engine room 44, between the left hood 47L located at the side of the engine room 44 (see FIG. 2) and the electrical component mounting board 100. Despite being not shown in the drawing, the second electrical component 102 mounted on the electrical component mounting board 100 may be located between the left hood 47L and the electrical component mounting board 100 in the engine room 44.

Therefore, in the present embodiment, it can be said that either the first electrical component 101 or the second electrical component 102 is located between the left hood 47L located at the side of the engine room 44 and the electrical component mounting board 100 in the engine room 44.

Figure 7:
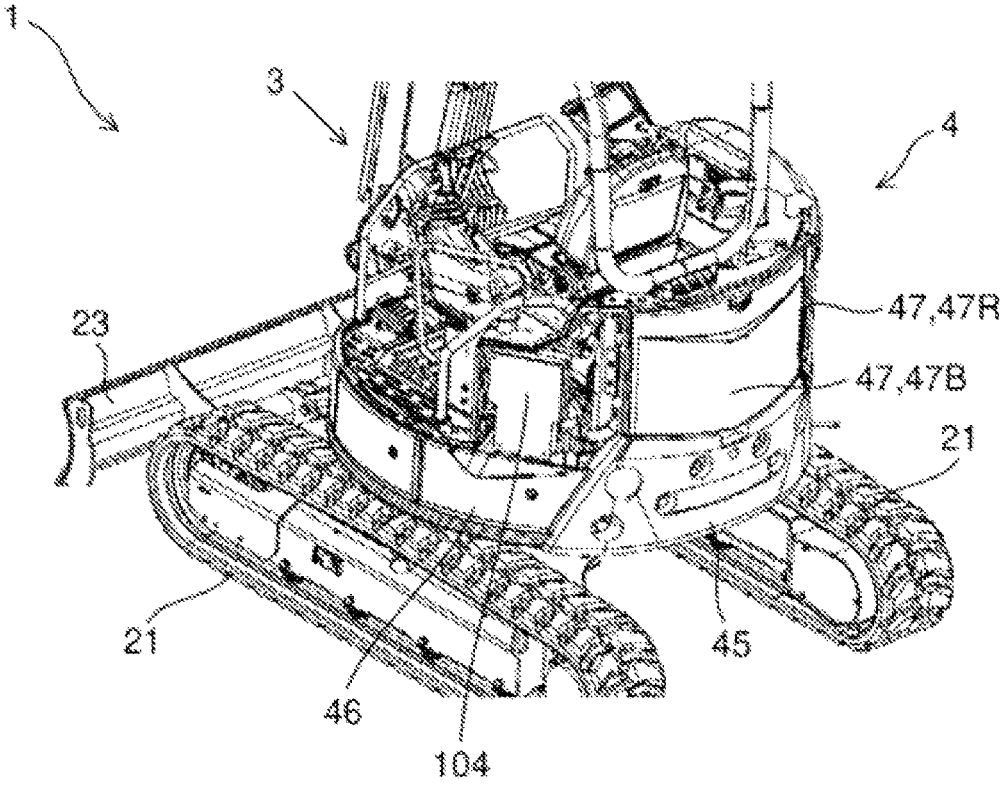
FIG. 7 is a rear perspective view of the above-mentioned hydraulic excavator with a left hood removed.
Figure 8:
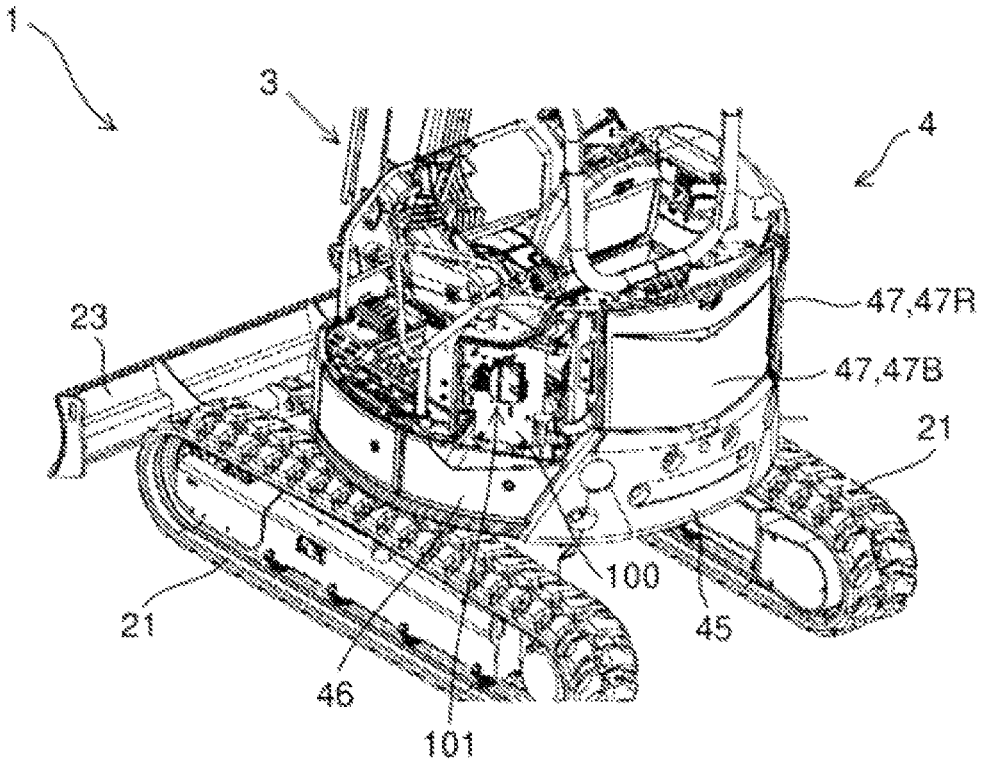
FIG. 8 is a rear perspective view of the above-mentioned hydraulic excavator with a cover removed from the above-mentioned electrical component mounting board.

FIG. 7 is a rear perspective view of the hydraulic excavator 1 with a left hood 47L removed. FIG. 8 is a rear perspective view of the hydraulic excavator 1 with a cover 104 (described in detail below) removed from the electrical component mounting board 100. For example, when the first electrical component 101 is located between the left hood 47L and the electrical component mounting board 100 in the engine room 44, removing the left hood 47L (see FIG. 7) and then removing the exposed cover 104 allow the operator (maintainer) to easily access the first electrical component 101 (see FIG. 8). Even when the second electrical component 102 is located between the left hood 47L and the electrical component mounting board 100 in the engine room 44, the same steps described above allow the operator to easily access the second electrical component 102.

Therefore, the operator can perform inspection, check or the like the electrical components located on the left hood 47L by simply removing the left hood 47L, that is, without removing the electrical component mounting board 100 from the engine room 44 (i.e., with the electrical component mounting board 100 installed in the engine room 44). As a result, maintenance for the above-mentioned electrical components can be easily performed.

Also, in the configuration where the electrical component mounting board 100 faces the left hood 47L in the engine room 44, the electrical component mounting board 100 is located vertically in the engine room 44. In other words, the front side 100*a* and the back side 100*b* of the electrical component mounting board 100 become parallel to each other in the vertical direction. Such a vertical arrangement of the electrical component mounting board 100 allows the narrow vertical space in the vicinity of the left hood 47L in the engine room 44 to be effectively utilized. In other words, the first electrical component 101 and the second electrical component 102 can be efficiently located together with the electrical component mounting board 100 in the above-mentioned narrower space in the engine room 44.

In addition, as mentioned above, in the present embodiment, the first electrical component 101 is the integrated ECU, and the second electrical component 102 is the engine ECU. The first electrical component 101 is located on the left hood 47L side with respect to the electrical component mounting board 100, and the second electrical component 102 is located on the opposite side of the left side of the left hood 47L with respect to the electrical component mounting board 100. In other words, the electrical component among the first electrical component 101 and the second electrical component 102, which is located on the opposite side to the left hood 47L with respect to the electrical component mounting board 100 is the controller (engine ECU) to control the engine 40 as the motor.

In the arrangement, a distance between the engine 40 as the motor located inside the engine room 44 and the second electrical component 102 which is a controller to control the engine 40 becomes to be shorter than that in a configuration where the second electrical component 102 is located on the left hood 47L side with respect to the electrical component mounting board 100, for example. This allows the wiring (harness) drawn from the second electrical component 102 toward the engine 40 to be shortened, thereby making handling of the wiring easier.

3. Attaching Method for Electrical Component Mounting Board

As shown in FIGS. 4 through 6, through holes 100*h* are formed at the periphery of the electrical component mounting board 100. In the drawings, three through holes 100*h* are formed along the edge of the electrical component mounting board 100, but the number of the through holes 100*h* is not limited thereto.

Figure 9:
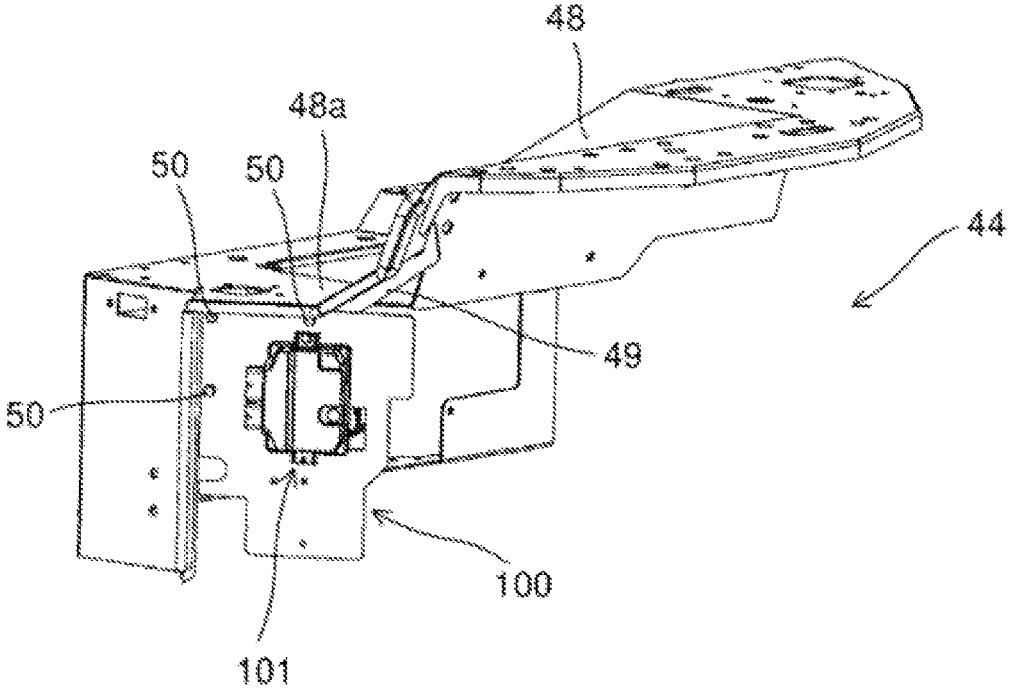
FIG. 9 is an enlarged perspective view of the inside of the above-mentioned engine room with the above-mentioned electrical component mounting board installed.
Figure 10:
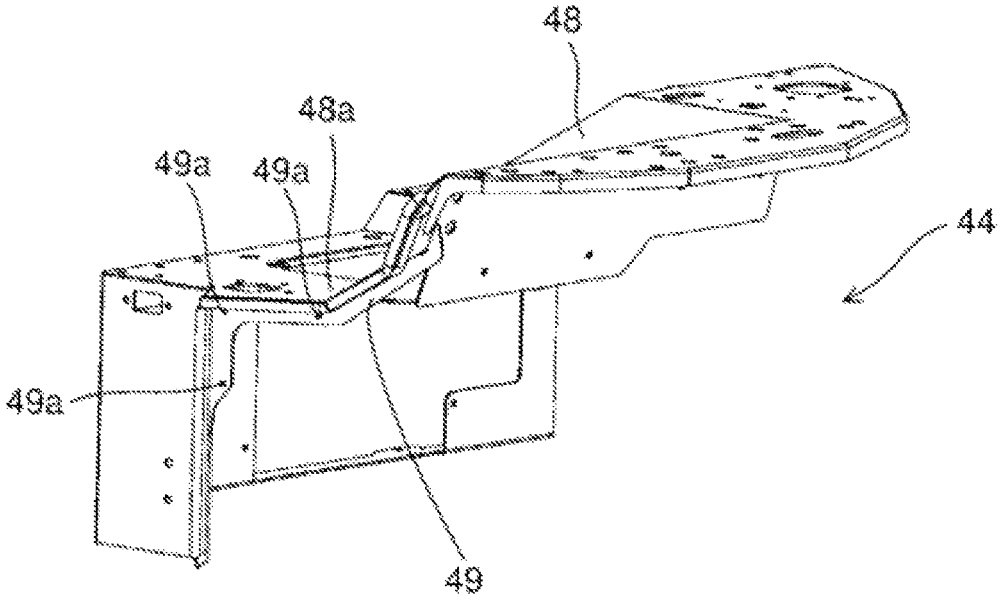
FIG. 10 is an enlarged perspective view of the inside of the above-mentioned engine room with the above-mentioned electrical component mounting board removed.

On the other hand, FIG. 9 is an enlarged perspective view of the inside of the engine room 44 with the electrical component mounting board 100 installed, Also, FIG. 10 is an enlarged perspective view of the inside of the engine room 44 with the electrical component mounting board 100 removed. As shown in FIG. 10, a bracket 49 is fixed on the engine room 44 side of the seat mount 48 by welding or the like. The bracket 49 is shaped to follow a concave-convex shape of the seat mount 48, which constitutes a top and front wall of the engine room 44 (e.g. L-shaped) and is fixed to the back side of the seat mount 48 (opposite to the side on which the seat is mounted). In the bracket 49, insertion holes 49*a* are formed at the positions corresponding to through holes 100*h* of the electrical component mounting board 100.

A method includes steps of overlaying the through holes 100*h* of the electrical component mounting board 100, of which the first electrical component 101 and the second electrical component 102 are mounted on the front and back side, on the insertion holes 49*a* of the bracket 49, inserting bolts 50 (see FIG. 9) as fastening members into the through holes 100*h* and the insertion holes 49*a* in this order, and screwing the bolts into the inner circumference of the nuts (not shown) located at an exit of the insertion holes 49*a*. This allows the electrical component mounting board 100 to be fixed to the back side of the seat mount 48 via the bracket 49. As a result, the electrical component mounting board 100 is located between the revolving frame 42 (see FIG. 3) and the seat mount 48 as well as closer to the seat mount 48. Namely, the electrical component mounting board 100 is located on the upper side of the engine room 44. When removing the electrical component mounting board 100, the electrical component mounting board 100 can be easily removed from the seat mount 48 (bracket 49) by loosening the bolts 50 to release connection with the nuts.

By the way, if rainwater during rainy weather or cleaning water during car washing (hereinafter referred to as rainwater, etc.) enters the inside of the engine room 44 through a gap in the outer wall of the engine room 44 (e.g., a gap between the left hood 47L and the rear hood 47B), rainwater, etc. flows through the inside of the engine room 44 downwardly. As mentioned above, in a configuration where the electrical component mounting board 100 is located closer to the seat mount 48 in the engine room 44, namely, in a configuration where the electrical component mounting board 100 is located on the upper side of the engine room 44, rainwater, etc. entering the engine room 44 (e.g., from the side) at a position below the electrical component mounting board 100 can reduce adversely affecting multiple electrical components mounted on the electrical component mounting board 100. For example, it is possible to reduce the risk of damage (failure) to multiple electrical components due to rainwater, etc. mentioned above.

A secure position where the electrical component mounting board 100 is fixed in the seat mount 48 may be only the part which constitutes an upper wall of the engine room 44 in the seat mount 48, or only the part which constitutes a front wall of the engine room 44 in the seat mount 48. In other words, the electrical component mounting board 100 may be supported from above, from forward (from the side), or from both above and forward in the engine room 44.

In any case, it is preferable that the electrical component mounting board 100 is positioned perpendicular to a horizontal portion 48*a* (see FIGS. 9 and 10) which constitutes a part of the ceiling of the engine room 44 in the seat mount 48. This configuration enables rainwater, etc. to fall down along the electrical component mounting board 100, even if rainwater, etc. enters the engine room 44 and touches the electrical component mounting board 100. This prevents rainwater, etc. from accumulating on the electrical component mounting board 100, thereby surely reducing the risk of damage to multiple electrical components, which is caused by rainwater, etc.

The hydraulic excavator 1 is also equipped with the bracket 49 fixed to the seat mount 48. The electrical component mounting board 100 is detachably fixed to the bracket 49 (using the bolts 50 and nuts).

Since the electrical component mounting board 100 is fixed to the seat mount 48 via the bracket 49, it is easy to fix the electrical component mounting board 100 to the back side (engine room 44 side) of the seat mount 48, regardless of the concave-convex shape of the seat mount 48. Also, by removing the left hood 47L, the operator can release the fixation of the electrical component mounting board 100 from the bracket 49 and remove the electrical component mounting board 100 from the inside of the engine room 44. This allows the operator to access the electrical component among the first electrical component 101 and the second electrical component 102 (e.g., the second electrical component 102), which is located farther from the left hood 47L with respect to the electrical component mounting board 100, and to perform maintenance on the above-mentioned electrical component. After removing the electrical component mounting board 100 from the inside of the engine room 44, the operator can perform maintenance on the other electrical component (first electrical component 101) as a matter of course.

4. Configuration of Electrical Components with Cooling Efficiency

As shown in FIGS. 4 through 6, the electrical component mounting board 100 has a board opening 100*p*. The board opening 100*p* is formed so as to pass through the electrical component mounting board 100 in a direction of thickness. The board opening 100*p* is formed in a rectangular shape in a plan view, for example, but may be formed in a polygonal shape, in a circular shape, in an oval shape, or the like, other than the rectangular shape.

The first electrical component 101 and the second electrical component 102 are each mounted on the electrical component mounting board 100 so as to cover a part of the board opening 100*p*. In other words, the part of the board opening 100*p* is positioned between the first electrical component 101 and second electrical component 102.

This configuration allows air (e.g., cooling air) in the engine room 44 to be applied through the board opening 100*p* from the side on which the electrical components are mounted (electrical component mounting board 100 side) to both the first electrical component 101 and the second electrical component 102 mounted on the electrical component mounting board 100. Also, heat generated by both the first electrical component 101 and the second electrical component 102 can be released to the outside through the board opening 100*p*. As a result, a cooling efficiency (heat dissipation efficiency) of both the first electrical component 101 and the second electrical component 102 can be increased.

Figure 11:
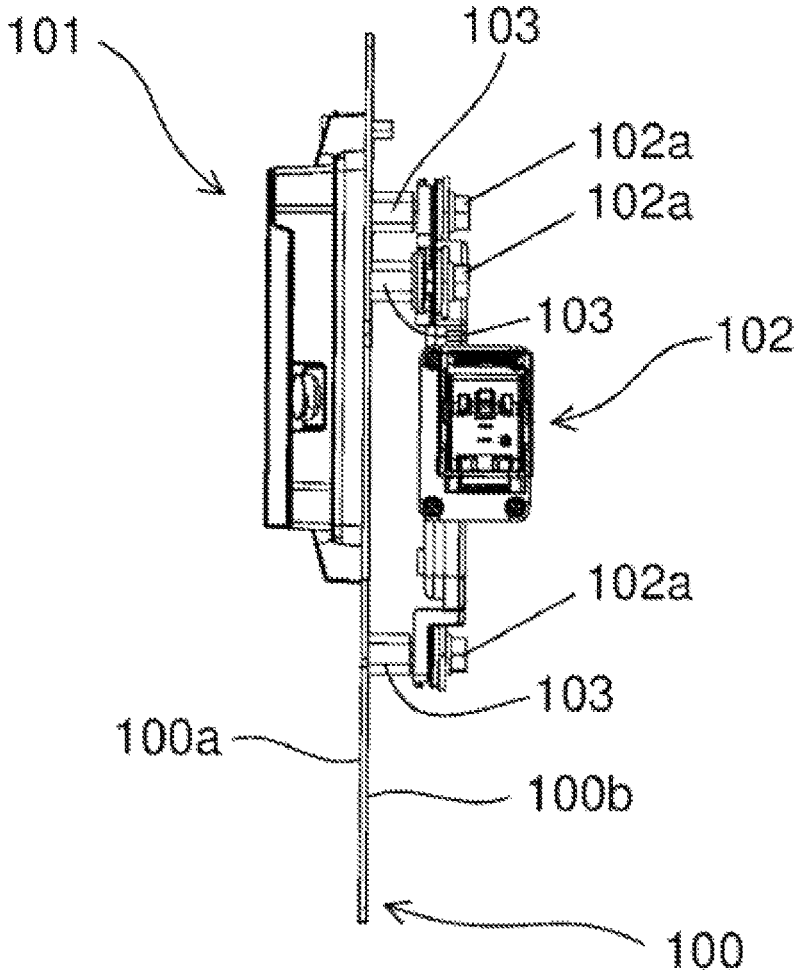
FIG. 11 is a side view of the above-mentioned electrical component mounting board with the above-mentioned first and second electrical components installed.

FIG. 11 is a side view of the electrical component mounting board 100 with the first electrical component 101 and the second electrical component 102 installed. In the present embodiment, the second electrical component 102 is mounted on the electrical component mounting board 100 through pillars 103. The pillars 103 are composed of nuts, for example. By inserting the bolts 102*a* for attaching the second electrical component 102 into the pillars 103, inserting them into the mounting holes 100*c*2 (see FIG. 5) of the electrical component mounting board 100, and screwing them into the inner circumference of the nuts (not shown) located on the first electrical component 101 side with respect to the electrical component mounting board 100, the second electrical component 102 is fixed to the electrical component mounting board 100 via the pillars 103.

The first electrical component 101 may be attached to the electrical component mounting board 100 via the pillars (not shown). In this case, by inserting the bolts 101*a* (see FIG. 4) for attaching the first electrical component 101 into the pillars mentioned above, inserting them into the mounting holes 100*c*1 (see FIG. 5) of the electrical component mounting board 100, and screwing them into the inner circumference of the nuts (not shown) located on the second electrical component 102 side with respect to the electrical component mounting board 100, the first electrical component 101 is fixed to the electrical component mounting board 100 via the pillars mentioned above.

Therefore, in the present embodiment, it can be said that at least one of the first electrical component 101 and the second electrical component 102 may be attached to the electrical component mounting board 100 via pillars (e.g., pillars 103).

This configuration make it possible to secure a gap as much as the height of the pillars (e.g., pillar 103) between the electrical component mounting board 100 and the electrical component (e.g., the second electrical component 102). Cooling air can be applied to the above-mentioned electrical components through the gap. Heat generated by the above-mentioned electrical components can also be released to the outside through the gap mentioned above. As a result, the cooling efficiency of the above-mentioned electrical components can be improved.

The height of the pillars defines the gap between the electrical component mounting board 100 and the electrical components, and the higher the pillars height is, the larger the above-mentioned gap is, resulting in improved cooling efficiency. Nuts having any height can be used as the nuts to constitute the pillar, but from the point of view of improving the cooling efficiency mentioned above, it is preferable to use taller nuts (high nuts) as the nuts.

It is desirable that an anti-vibration member such as anti-vibration rubber is provided between the pillars 103 and the electrical components (e.g., the second electrical component 102). In this case, the vibration generated by the hydraulic excavator 1 and transmitted to the electrical components via the electrical component mounting member 100 and the pillars 103 can be absorbed by the anti-vibration member. This makes it possible to reduces damage to electrical components caused by the vibration mentioned above.

5. Cover

Figure 12:
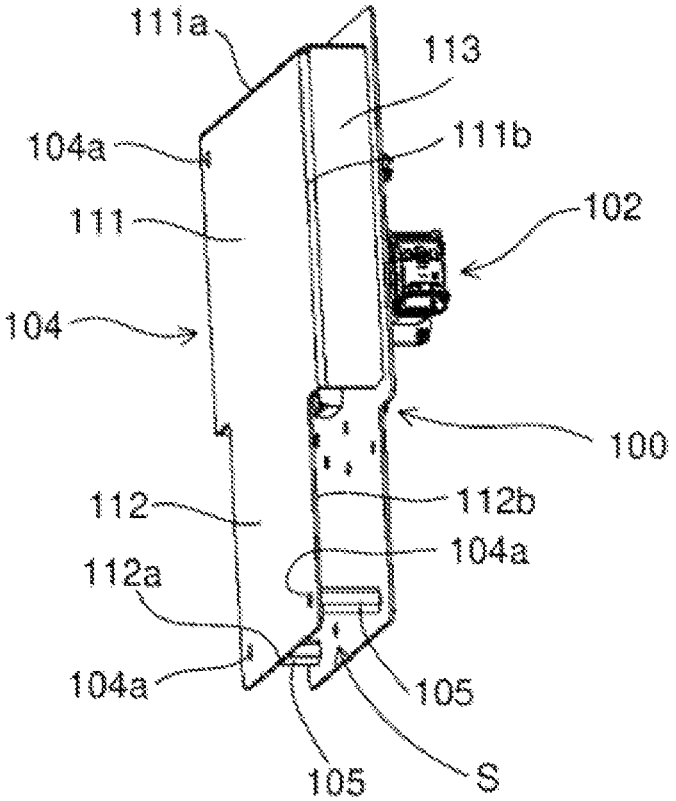
FIG. 12 is a perspective view of the above-mentioned cover with being attached to the above-mentioned electrical component mounting board.
Figure 13:
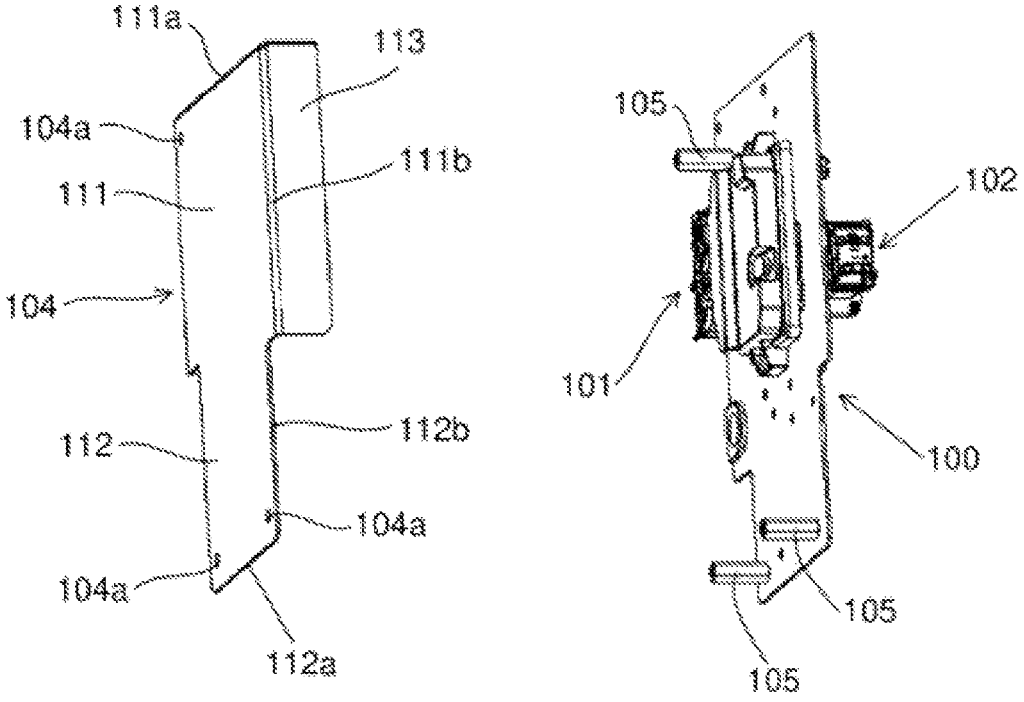
FIG. 13 is a perspective view of the above-mentioned cover with being separated from the above-mentioned electrical component mounting board.

FIG. 12 is a perspective view of the cover 104 with being attached to the electrical component mounting board 100. FIG. 13 is a perspective view of the cover 104 with being separated from the electrical component mounting board 100. The cover 104 protects the first electrical component 101 by covering the first electrical component 101 against the electrical component mounting board 100.

The cover 104 is attached to the electrical component mounting board 100 using spacers 105. The spacer 105 is a hollow member, for example. The cover 104 has holes 104*a* in predetermined positions, into which bolts (not shown) are inserted. The electrical component mounting board 100 also has holes (not shown) corresponding to the positions of the above-mentioned holes 104*a* of the cover 104. By Inserting the above-mentioned bolts into the holes 104*a* of the cover 104, the spacers 105, and the holes of the electrical component mounting board 100 in this order, and screwing them into the inner circumference of the nuts (not shown) located on the second electrical component 102 side of the electrical component mounting board 100, the cover 104 can be attached to the electrical component mounting board 100.

The electrical component mounting board 100 may be provided with another cover to cover the second electrical component 102. Therefore, it can be said that the hydraulic excavator 1 according to the present embodiment may have a cover (e.g., cover 104) which is provided for the electrical component mounting board 100 and separately covers at least one of the first electrical component 101 and the second electrical components 102. The following is a detailed description of the cover 104 covering the first electrical component 101, but the configuration of the cover 104 is also applicable to the cover covering the second electrical component 102.

The cover 104 has first flat section 111 and second flat section 112. The first flat section 111 and the second flat section 112 are located on the same plane and are connected in the vertical direction. The first flat section 111 is located upper than the second flat section 112. The first flat section 111 and the second flat section 112 are positioned so as to face the electrical component mounting board 100.

The first flat section 111 has top end 111*a* and side end 111*b*. The top end 111*a* and the side end 111*b* are connected to a sidewall 113. An end of the sidewall 113 opposite to the first flat section 111 can be in contact with the electrical component mounting board 100.

The second flat section 112 has lower end 112*a* and side end 112*b*. No sidewalls corresponding to the sidewalls 113 of the first flat section 111 are connected to the lower end 112*a* and the side end 112*b*. For this reason, when the cover 104 is attached to the electrical component mounting board 101, a gap S (see FIG. 12) corresponding to the height of the side wall 113 of the first flat section 111 (the height in the direction where the first flat section 111 faces the electrical component mounting board 100) is formed between the lower end 112*a* and the side end 112*b* of the second flat section 112, and the electrical component mounting board 100.

It should be noted that the side end 112*b* of the second flat section 112 may have a sidewall corresponding to the sidewall 113 of the first flat section 111, and it may be connected to the sidewall 113. In this case, when the cover 104 is attached to the electrical component mounting board 101, a gap S corresponding to the height of the side wall 113 of the first flat section 111 is formed between the lower end 112*a* of the second flat section 112 and the electrical component mounting board 100.

Anyway, it can be said that the cover 104 has the lower end 112*a* facing the electrical component mounting board 100 via the gap S.

Even when rainwater, etc. enters the engine room 44. the above-mentioned configuration of the cover 104 allows the rainwater, etc. to flow out downwardly through the gap S between the lower end 112*a* of the cover 104 and the electrical component mounting board 100. This makes it possible to avoid damage to electrical components (e.g., the first electrical component 101) due to rainwater, etc., accumulating inside the cover 104. In other words, the electrical components can be protected from rainwater, etc. In addition, cooling air can be applied through the gap S to the electrical components covered by the cover 104, and heat generated by the electrical components can be discharged outside through the gap S. This also allows the cooling efficiency of the electrical components to be improved.

6. Others

In the present embodiment, the electrical component mounting board 100 is arranged vertically in the engine room 44, but it may also be arranged horizontally. Even such an example is nothing but the above-mentioned embodiment in that multiple electrical components can be collectively mounted on a single electrical component mounting board 100 and located in the engine room 44. Accordingly, it is possible to achieve such an effect similar to the present embodiment that multiple electrical components can be efficiently arranged in the engine room 44 with a small number of components using one electrical component mounting board 100.

In the present embodiment, the hydraulic excavator 1 which is a construction machine has been described as an example of a work machine, but the work machine is not limited to the hydraulic excavator 1 and can be other construction machines such as wheel loaders, or agricultural machines such as combine harvesters, tractors, etc.

The embodiment of the present invention has been described above, but the scope of the invention is not limited thereto. The invention can be carried out within an extended or modified range without departing from the gist of the invention.

INDUSTRIAL APPLICABILITY

The present invention is applicable to construction machinery, agricultural machinery, and other work machinery, for example.

REFERENCE SIGNS LIST

1 Hydraulic excavator (work equipment)
40 Engine (motor)
42 Revolving frame
44 Engine room
48 Seat mount
48*a* Horizontal portion
49 Bracket
74L Left hood (hood)
100 Electrical component mounting board
100*a* Front side
100*b* Back side
100*p* Board opening
101 First electrical component
102 Second electrical component
103 Pillar
104 Cover
112*a* Lower end
S Gap

The invention claimed is:

1. A work machine with an engine room comprising:
an electrical component mounting board located in the engine room on which electrical components are mounted;
a revolving frame located at a bottom of the engine room; and
a seat mount located above the revolving frame and being a part of an outer wall of the engine room,
wherein the electrical component mounting board is located above the revolving frame and below the seat mount, and is positioned so as to face a hood, which is located on a side of the engine room and at a rear of the working machine,
the electrical components including a first electrical component and a second electrical component, wherein the first electrical component is mounted on either a front side or a back side of the electrical component mounting board, and the second electrical component is mounted on the other of the front side or back side of the electrical component mounting board.

2. The work machine according to claim 1, wherein the electrical component mounting board is positioned vertically in the engine room and below a horizontal portion of the seat mount that forms a portion of a ceiling of the engine room.

3. The work machine according to claim 1 further comprising a bracket that is fixed to the seat mount on the engine room side,
wherein the electrical component mounting board is detachably fixed to the bracket.

4. A work machine with an engine room comprising:
a motor that is installed in the engine room;
an electrical component mounting board located in the engine room on which electrical components are mounted;
a revolving frame located at a bottom of the engine room; and
a seat mount located above the revolving frame and being a part of an outer wall of the engine room,
wherein the electrical component mounting board is located above the revolving frame and below the seat mount, and is positioned so as to face a hood located on a side of the engine room and positioned at a rear of the working machine;
the electrical components including a first electrical component and a second electrical component, wherein the first electrical component is mounted on either a front side or a back side of the electrical component mounting board, and the second electrical component is mounted on the other of the front side or back side of the electrical component mounting board,
wherein either the first electrical component or the second electrical component is located between the hood and the electrical component mounting board in the engine room,
an electrical component among the first electrical component and the second electrical component, which is located on an opposite side to the hood with respect to the electrical component mounting board, is a controller to control the motor.

5. The work machine according to claim 4, further comprising a cover that is provided for the electrical component mounting board and that separately covers at least one of the first electrical component and the second electrical component, wherein the cover has a lower end that faces the electrical component mounting board via a gap.

6. The work machine according to claim 4, wherein at least one of the first electrical component and the second electrical component is attached to the electrical component mounting board via a pillar.

7. The work machine according to claim 4, wherein the electrical component mounting board has a board opening that passes through in a thickness direction, and
a part of the board opening is located between the first electrical component and the second electrical component.

8. A work machine with an engine room comprising:
an electrical component mounting board located in the engine room;
electrical components including a first electrical component and a second electrical component, wherein the first electrical component is mounted on either a front side or a back side of the electrical component mounting board, and the second electrical component is mounted on the other of the front side or back side of the electrical component mounting board,
wherein the electrical component mounting board is positioned so as to face a hood, which is located on a side of the engine room and at a rear of the working machine, and
either the first electrical component or the second electrical component is located between the hood and the electrical component mounting board in the engine room, and the electrical component mounting board is positioned under the seat mount.

9. The work machine according to claim 8, further comprising:
a motor that is installed in the engine room;
wherein either the first electrical component or the second electrical component is located between the hood and the electrical component mounting board in the engine room, and an electrical component among the first electrical component and the second electrical component, which is located on an opposite side to the hood with respect to the electrical component mounting board, is a controller to control the motor.

* * * * *